US010976678B2

(12) United States Patent
Yamawaki et al.

(10) Patent No.: US 10,976,678 B2
(45) Date of Patent: Apr. 13, 2021

(54) TONER

(71) Applicant: CANON KABUSHIKI KAISHA, Tokyo (JP)

(72) Inventors: Kentaro Yamawaki, Mishima (JP); Shohei Kototani, Suntou-gun (JP); Noriyoshi Umeda, Suntou-gun (JP); Tomonori Matsunaga, Suntou-gun (JP); Shohei Tsuda, Suntou-gun (JP); Satoshi Otsuji, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/728,060

(22) Filed: Dec. 27, 2019

(65) Prior Publication Data

US 2020/0209766 A1 Jul. 2, 2020

(30) Foreign Application Priority Data

Dec. 28, 2018 (JP) ..... JP2018-246994

(51) Int. Cl.
*G03G 9/08* (2006.01)
*G03G 9/087* (2006.01)
*G03G 9/097* (2006.01)

(52) U.S. Cl.
CPC ..... *G03G 9/0819* (2013.01); *G03G 9/08711* (2013.01); *G03G 9/09725* (2013.01); *G03G 9/09775* (2013.01)

(58) Field of Classification Search
CPC ..... G03G 9/09725; G03G 9/09775
USPC ..... 430/108.3, 108.6
See application file for complete search history.

(56) References Cited

U.S. PATENT DOCUMENTS

| | | | |
|---|---|---|---|
| 7,135,263 | B2 | 11/2006 | Kawakami et al. |
| 7,611,813 | B2 | 11/2009 | Ida et al. |
| 7,767,370 | B2 | 8/2010 | Ishigami et al. |
| 8,114,562 | B2 | 2/2012 | Ishigami et al. |
| 9,213,251 | B2 | 12/2015 | Ohmori et al. |
| 9,261,806 | B2 | 2/2016 | Moribe et al. |
| 9,285,697 | B2 | 3/2016 | Fukudome et al. |
| 9,341,967 | B2 | 5/2016 | Tsujino et al. |
| 9,366,981 | B2 | 6/2016 | Yamawaki et al. |
| 9,470,993 | B2 | 10/2016 | Nishikawa et al. |
| 9,575,425 | B2 | 2/2017 | Naka et al. |
| 9,588,450 | B2 | 3/2017 | Tsuda et al. |
| 9,606,462 | B2 | 3/2017 | Nomura et al. |
| 9,658,546 | B2 | 5/2017 | Tanaka et al. |
| 9,715,188 | B2 | 7/2017 | Terauchi et al. |
| 9,772,570 | B2 | 9/2017 | Tsuda et al. |
| 9,778,583 | B2 | 10/2017 | Terauchi et al. |
| 9,785,068 | B2 | 10/2017 | Umeda et al. |
| 9,857,707 | B2 | 1/2018 | Tsuda et al. |
| 9,904,195 | B2 | 2/2018 | Matsui et al. |
| 10,012,919 | B2 | 7/2018 | Matsui et al. |
| 10,156,800 | B2 | 12/2018 | Tsuda et al. |
| 10,197,934 | B2 | 2/2019 | Matsui et al. |
| 10,303,074 | B2 | 5/2019 | Yamawaki et al. |
| 10,429,757 | B2 | 10/2019 | Yoshida et al. |
| 10,503,090 | B2 | 12/2019 | Tominaga et al. |
| 10,578,990 | B2 | 3/2020 | Tsuda et al. |
| 2004/0058258 | A1 | 3/2004 | Yoshino et al. |
| 2004/0137356 | A1 | 7/2004 | Tomita et al. |
| 2008/0226998 | A1 | 9/2008 | Ishii et al. |
| 2009/0117477 | A1 | 5/2009 | Magome et al. |
| 2009/0155706 | A1 | 6/2009 | Shu et al. |
| 2010/0248110 | A1 | 9/2010 | Taguchi et al. |
| 2014/0220488 | A1 | 8/2014 | Hosoya et al. |
| 2015/0125790 | A1 | 5/2015 | Hotta et al. |
| 2016/0187799 | A1 | 6/2016 | Hiroshi et al. |
| 2016/0299446 | A1 | 10/2016 | Kuroki et al. |
| 2017/0219947 | A1 | 8/2017 | Omori et al. |
| 2017/0329246 | A1 | 11/2017 | Yamawaki et al. |
| 2018/0329323 | A1 | 11/2018 | Kimura et al. |
| 2018/0329324 | A1 | 11/2018 | Kamikura et al. |
| 2018/0329327 | A1 | 11/2018 | Yamawaki et al. |
| 2018/0329329 | A1 | 11/2018 | Nakamura et al. |
| 2019/0041762 | A1 | 2/2019 | Yoshiba et al. |
| 2019/0332024 | A1 | 10/2019 | Umeda et al. |

(Continued)

FOREIGN PATENT DOCUMENTS

| | | |
|---|---|---|
| EP | 0 430 076 | 6/1991 |
| EP | 2 669 740 | 12/2013 |
| EP | 2 818 932 | 12/2014 |

(Continued)

OTHER PUBLICATIONS

U.S. Appl. No. 16/728,050, Tsuneyoshi Tominaga, filed Dec. 27, 2019.
U.S. Appl. No. 16/728,082, Yasuhiro Hashimoto, filed Dec. 27, 2019.
U.S. Appl. No. 16/728,101, Taiji Katsura, filed Dec. 27, 2019.
U.S. Appl. No. 16/728,115, Shotaru Nomura, filed Dec. 27, 2019.
U.S. Appl. No. 16/728,122, Masamichi Sato, filed Dec. 27, 2019.

(Continued)

*Primary Examiner* — Mark A Chapman
(74) *Attorney, Agent, or Firm* — Venable LLP

(57) ABSTRACT

Provided is a toner including a toner particle containing a binder resin, and an external additive, wherein the external additive contains an external additive A and an external additive B, the external additive A is an organosilicon polymer fine particle, the number-average particle diameter of primary particles of the organosilicon polymer fine particle is from 30 to 300 nm, the external additive B is a silica fine particle, the number-average particle diameter of primary particles of the silica fine particle is from 100 to 300 nm, the fixing rate of the external additive A to the toner particle according to a water washing method is less than 30%, and the fixing rate of the external additive B to the toner particle according to the washing method is at least 30%.

6 Claims, No Drawings

(56) References Cited

U.S. PATENT DOCUMENTS

| | | | |
|---|---|---|---|
| 2020/0026208 | A1 | 1/2020 | Terui et al. |
| 2020/0026209 | A1 | 1/2020 | Yagi et al. |

FOREIGN PATENT DOCUMENTS

| | | |
|---|---|---|
| EP | 2 853 945 | 4/2015 |
| EP | 2 860 585 | 4/2015 |
| EP | 3 095 805 | 11/2016 |
| EP | 3 480 661 | 5/2019 |
| JP | 2010-249995 | 11/2010 |
| JP | 2013-156614 | 8/2013 |
| WO | 2018/003749 | 1/2018 |

OTHER PUBLICATIONS

U.S. Appl. No. 16/728,151, Masatake Tanaka, filed Dec. 27, 2019.
U.S. Appl. No. 16/728,157, Shohei Kototani, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.

TONER

BACKGROUND OF THE INVENTION

Field of the Invention

The present invention relates to a toner for use in image-forming methods such as electrophotographic methods.

Description of the Related Art

Electrophotographic image forming apparatus are being subject to demands for size reduction and longer service lives, and further improvements in various properties of the toner are in demand to meet these requirements.

From the standpoint of size reduction, efforts have already been made to save space with various units. In particular, various efforts have been made to improve transferability, because the waste toner container that collects untransferred toner from the photosensitive drum can be made smaller if toner transferability is improved.

In the transfer step, toner on the photosensitive drum is transferred to a medium such as paper. To improve transferability, it is important to reduce the attachment force between the toner and the photosensitive drum to facilitate detachment of the toner from the photosensitive drum. One technique that is known for doing this is to externally add a large-diameter silica particle with a particle diameter of about 100 to 300 nm.

However, toner flowability is reduced when a large-diameter silica particle is externally added. This can cause problems of charging performance, particularly with the rise of charge and charging performance in high-temperature, high-humidity environments.

Methods of compensating for the drop in flowability and charging performance include (1) adding a large quantity of a small-diameter silica particle and (2) combining a small-diameter silica particle with a large-diameter silica particle.

Specific applied examples of the method of (1) above are described in Japanese Patent Application Publication No. 2013-156614 and the like.

The toner described in Japanese Patent Application Publication No. 2013-156614 has high durability, and can maintain a certain degree of developing performance even in the second half of an endurance test.

Specific applied examples of the method of (2) above are described in Japanese Patent Application Publication No. 2010-249995 and the like.

The configuration described in Japanese Patent Application Publication No. 2010-249995 is aimed at achieving both good charging performance with the small-diameter silica particle and an embedding prevention effect with the large-diameter silica particle.

SUMMARY OF THE INVENTION

Issues with the configuration described in Japanese Patent Application Publication No. 2013-156614 include various problems caused by electrostatic aggregation of the large quantity of externally added small-diameter silica particles.

Specifically, electrostatic aggregations of small-diameter silica particles formed on the toner surface detach and adhere to the surface of the photosensitive member, contaminating the member and disrupting the electrostatic latent image, and image quality also declines due to a drop in toner flowability.

During durable output, moreover, when small-diameter silica particles aggregate electrostatically on the toner surface the coverage rate by the particles declines, reducing toner flowability and causing image problems due to poor toner regulation.

Poor toner regulation occurs when the cumulative amount of the toner on the toner carrying member is not adequately regulated by the toner control member, so that the toner laid-on level on the toner carrying member exceeds the desired amount, causing image problems such as developing ghosts in which the image density is greater than the desired density.

In the configuration described in Japanese Patent Application Publication No. 2010-249995, although durable performance is improved with the large-diameter silica particles, the small-diameter silica particles become embedded before the large-diameter silica particles during the second half of endurance testing, changing the charging performance and flowability of the toner and causing image changes.

Consequently, there is demand for techniques for achieving flowability even when using a large-diameter silica particle without relying on the above methods, and for techniques whereby this flowability can be maintained and contamination of the members can be prevented even during durable image output.

The present invention provides a toner that solves these problems.

Specifically, it provides a toner whereby excellent flowability can be achieved and contamination of the members can be prevented even during durable image output even when a large-diameter silica particle is externally added to improve transferability.

The present invention relates to a toner including:

a toner particle containing a binder resin, and an external additive, wherein the external additive contains an external additive A and an external additive B, the external additive A is an organosilicon polymer fine particle, a number-average particle diameter of primary particles of the organosilicon polymer fine particle is from 30 to 300 nm, the external additive B is a silica fine particle, a number-average particle diameter of primary particles of the silica fine particle is from 100 to 300 nm, a fixing rate of the external additive A to the toner particle according to a water washing method is less than 30%, and a fixing rate of the external additive B to the toner particle according to the washing method is at least 30%.

With the present invention, it is possible to provide a toner which has excellent transferability and with which excellent flowability can be achieved and contamination of the members can be prevented during durable image output.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" in the present invention include the numbers at the upper and lower limits of the range.

According to the inventors' researches, high image quality can be maintained to a certain extent even during long-term durable image output by the conventional technique of adding a large quantity of a small-diameter silica particle.

However, this causes production and detachment of aggregates caused by electrostatic aggregation of the small-diameter silica particles, and the resulting drop in coverage rate causes a variety of problems.

Using a small-diameter silica particle in combination with a large-diameter silica particle, it is possible to suppress embedding of the small-diameter silica particle to a certain degree, and maintain high charging performance and flowability over a longer time than in the past. However, selective embedding of the small-diameter silica particles and consequent changes in the physical properties still occur during the late stage of durable image output. Thus, this is not a fundamental solution.

The inventors then discovered as a result of further study that these problems could be solved by using an organosilicon polymer fine particle with a specific particle diameter in combination with a large-diameter silica particle, and by controlling the fixing rates of the large-diameter silica particle and organosilicon polymer fine particle at specific rates.

That is, the present invention is a toner including:

a toner particle containing a binder resin, and an external additive, wherein the external additive contains an external additive A and an external additive B, the external additive A is an organosilicon polymer fine particle, a number-average particle diameter of primary particles of the organosilicon polymer fine particle is from 30 to 300 nm, the external additive B is a silica fine particle, a number-average particle diameter of primary particles of the silica fine particle is from 100 to 300 nm, a fixing rate of the external additive A to the toner particle according to a water washing method is less than 30%, and a fixing rate of the external additive B to the toner particle according to the washing method is at least 30%.

The external additive contains an external additive A and an external additive B, and the external additive A is an organosilicon polymer fine particle, while the external additive B is a silica fine particle.

The number-average particle diameter of the primary particles of the silica fine particle is from 100 to 300 nm, and the number average particle diameter of the primary particles of the organosilicon polymer fine particle is from 30 to 300 nm.

Furthermore, the fixing rate of the silica fine particle is controlled so as to be at least 30%, and the fixing rate of the organosilicon polymer fine particle is controlled so as to be less than 30%. The reason why the problems are solved with this configuration is thought to be as follows.

The pencil hardness of the binder resin used in the toner particle is generally softer than HB. However, the pencil hardness of the silica commonly used as an external additive is about 8H to 9H. That is, there is a large difference in hardness between the soft toner particle and the hard silica used as an external additive, meaning that a hard substance is pressed against a soft substance, and the external additive is likely to become embedded in the matrix.

When a large-diameter silica particle and a small-diameter silica particle are combined in conventional technology, moreover, the small-diameter silica particle has a greater curvature than the large-diameter silica particle, and is thus more likely to become embedded. It is thought that the loss of flowability during durable image output may be attributable to embedding of the small-diameter silica particle.

We then arrived at the idea of using an organosilicon polymer fine particle with a suitable degree of hardness.

The hardness of an organosilicon polymer fine particle is normally a pencil hardness of about 3H to 7H, giving it a hardness intermediate between organic matter and inorganic matter.

We discovered that combining a large-diameter silica with the number-average particle diameter described above with an organosilicon polymer fine particle with the number-average particle diameter described above was especially desirable not only due to the effect of suppressing embedding of these fine particles in the toner particle, but also because of the way the external additives are fixed on the toner particle.

By choosing a combination of fine particles having these physical properties as external additives, it is possible to facilitate the fixing of the large-diameter silica particle while inhibiting the fixing of the organosilicon polymer fine particle.

When this state is realized, the organosilicon polymer fine particle can roll between toner particles and function as a spacer due to its low fixing rate, resulting in a dramatic flowability improvement effect.

Furthermore, embedding is unlikely during durable image output due to the rolling of the medium-hardness fine particles with the above particle diameter, allowing flowability to be maintained long-term.

Looking at the organosilicon polymer fine particle with a number-average particle diameter of from 30 to 300 nm of the primary particles (hereunder called external additive A), the particle is likely to become embedded and flowability is difficulty to achieve during durable image output if the particle diameter is less than 30 nm because the curvature is large.

If the particle diameter exceeds 300 nm, on the other hand, the particle is less likely to be retained stably on the toner particle surface, and contamination of the members may occur.

The number-average particle diameter of the primary particles of the organosilicon polymer fine particle is preferably from 50 to 200 nm, or more preferably from 70 to 150 nm.

Looking at the silica fine particle with a number-average particle diameter of from 100 to 300 nm of the primary particles (hereunder also called the large-diameter silica fine particle or the external additive B), if the particle diameter is less than 100 nm the effect of improving transferability, which was the original reason for adding the particle, cannot be obtained sufficiently.

If the particle diameter exceeds 300 nm, on the other hand, the particle is less likely to be retained stably on the toner particle surface, and contamination of the members may occur.

The number-average particle diameter of the primary particles of the silica fine particle is more preferably from 100 to 250 nm, or still more preferably from 100 to 200 nm.

The fixing rate of the external additive A to the toner particle according to the water washing method is less than 30%, or more preferably not more than 25%, or still more preferably not more than 20%. This fixing rate is also preferably at least 3%. These numerical ranges may be combined at will.

The fixing rate of the external additive B to the toner particle according to the washing method is at least 30%, or more preferably at least 35%, or still more preferably at least 40%. This fixing rate is also preferably not more than 95%. These numerical ranges may be combined at will.

The fixing rates can be controlled by controlling the material input sequence when adding the external additives, and the temperature and rotational speed during external addition and the like.

If the fixing rate of the external additive A exceeds 30%, this means that less of the organosilicon polymer fine particle rolls between the toner particles, so that flowability may be insufficient, and this flowability may not be obtained throughout durable image output.

If the fixing rate of the external additive B is less than 30%, on the other hand, sufficient transferability may not be obtained.

The content of the external additive A in the toner is preferably from 0.50 to 6.00 mass %, or more preferably from 1.00 to 5.00 mass %.

If the content of the external additive A is at least 0.50 mass %, flowability can be further improved, whereas if the content of the external additive A is not more than 6.00 mass %, it is possible to prevent contamination of the members by excess external additive.

The content of the external additive B in the toner is preferably from 0.10 to 3.00 mass %, or more preferably from 0.20 to 2.00 mass %.

If the content of the external additive B is at least 0.10 mass %, better transferability can be obtained. If the content of the external additive B is not more than 3.00 mass %, contamination of the members can be prevented.

It has been found that if the contents of the external additive A and external additive B are combined within the above ranges, it is possible to resolve the problems (such as fogging) with charging performance in high-temperature, high-humidity environments that occur when a large-diameter silica particle is externally added.

This is thought to be because the rise of charge is improved due to the further improvement in flowability.

The shape factors SF-1 of the external additive A and external additive B are preferably from 100 to 114, or more preferably from 100 to 112.

If the external additive A and external additive B have shape factors SF-1 within this range, they can roll more easily on the toner surface, resulting in better flowability.

The shape factor SF-1 is an indicator of the circularity of the particle, with a shape factor of 100 indicating a true circle, and with larger numbers indicating irregular shapes that deviate more from the true circle the larger the number.

The external additive A and external additive B may or may not be treated with an organic hydrophobic agent.

The shape factors SF-1 of the external additive A and external additive B can be controlled within the above ranges by controlling the conditions when manufacturing the external additives, such as the raw material monomers and the difference in the surface tension of the reaction field.

An external additive C may also be included in the external additives.

The external additive C is at least one fine particle selected from the group consisting of the titanium oxide fine particles and strontium titanate fine particles.

The fixing rate of the external additive C to the toner particle according to the washing method is preferably at least 40%, or more preferably at least 45%. The fixing rate is also preferably not more than 95%, or more preferably not more than 90%. These numerical ranges may be combined at will.

Titanium oxide and strontium titanate are low resistance materials that allow charge accumulation to leak appropriately and therefore have the effect of suppressing charge-up, and they are more effective at suppressing electrostatic aggregation when fixed to the toner particle surface.

The organosilicon polymer fine particle, which is the external additive A, is explained in detail below.

The organosilicon polymer fine particle has a structure of alternately bonded silicon atoms and oxygen atoms, and part of the organosilicon polymer preferably has a T3 unit structure represented by $R^aSiO_{3/2}$. $R^a$ is preferably a hydrocarbon group, and more preferably a $C_{1-6}$ (preferably $C_{1-3}$, more preferably $C_{1-2}$) alkyl group or phenyl group.

In $^{29}$Si-NMR measurement of the organosilicon polymer fine particle, moreover, a ratio of an area of a peak derived from silicon having the T3 unit structure relative to a total area of peaks derived from all silicon elements contained in the organosilicon polymer fine particle is preferably from 0.50 to 1.00, or more preferably from 0.70 to 1.00.

The method of manufacturing the organosilicon polymer fine particle is not particularly limited, and for example it can be obtained by dripping a silane compound into water, hydrolyzing it with a catalyst and performing a condensation reaction, after which the resulting suspension is filtered and dried. The particle diameter can be controlled by means of the type and compounding ratio of the catalyst, the reaction initiation temperature, and the dripping time and the like.

Examples of the catalyst include, but are not limited to, acidic catalysts such as hydrochloric acid, hydrofluoric acid, sulfuric acid, nitric acid and the like, and basic catalysts such as ammonia water, sodium hydroxide, potassium hydroxide and the like.

The organosilicon compound for producing the organosilicon polymer fine particle is explained below.

The organosilicon polymer is preferably a polycondensate of an organosilicon compound having a structure represented by the following formula (Z):

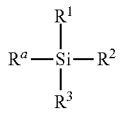

(Z)

In formula (Z), $R^a$ represents an organic functional group, and each of $R^1$, $R^2$ and $R^3$ independently represents a halogen atom, hydroxyl group or acetoxy group, or a (preferably $C_{1-3}$) alkoxy group.

$R^a$ is an organic functional group without any particular limitations, but preferred examples include $C_{1-6}$ (preferably $C_{1-3}$, more preferably $C_{1-2}$) hydrocarbon groups (preferably alkyl groups) and aryl (preferably phenyl) groups.

Each of $R^1$, $R^2$ and $R^3$ independently represents a halogen atom, hydroxyl group, acetoxy group or alkoxy group. These are reactive groups that form crosslinked structures by hydrolysis, addition polymerization and condensation. Hydrolysis, addition polymerization and condensation of $R^1$, $R^2$ and $R^3$ can be controlled by means of the reaction temperature, reaction time, reaction solvent and pH. An organosilicon compound having three reactive groups ($R^1$, $R^2$ and $R^3$) in the molecule apart from $R^a$ as in formula (Z) is also called a trifunctional silane.

Examples of formula (Z) include the following:

trifunctional methylsilanes such as p-styryl trimethoxysilane, methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl diacetoxymethoxysilane, methyl diacetoxyethoxysilane, methyl acetoxydimethoxysilane, methyl acetoxymethoxyethoxysilane, methyl acetoxydiethoxysilane, methyl trihydroxysilane, methyl methoxydihydroxysilane, methyl ethoxydihydroxysilane, methyl dimethoxyhydroxysilane, methyl ethoxymethoxyhydroxysilane and methyl diethoxyhydroxysilane; trifunctional ethylsilanes such as ethyl trimethoxysilane, ethyl triethoxysilane, ethyl trichlorosilane, ethyl triacetoxysilane and ethyl trihydroxysilane; trifunctional propylsilanes such as propyl trimethoxysilane, propyl triethoxysilane, propyl trichlorosilane, propyl triacetoxysilane and propyl trihydroxysilane; trifunctional butylsilanes such as butyl trimethoxysilane, butyl triethoxysilane, butyl trichlorosilane, butyl triacetoxysilane and butyl trihydroxysilane; trifunctional hexylsilanes such as hexyl trimethoxysilane, hexyl triethoxysilane, hexyl trichlorosilane, hexyl triacetoxysilane and hexyl trihydroxysilane; and trifunctional phenylsilanes such as phenyl trimethoxysilane, phenyl triethoxysilane, phenyl trichlorosilane, phenyl triacetoxysilane and phenyl trihydroxysilane. These organosilicon compounds may be used individually, or two or more kinds may be combined.

The following may also be used in combination with the organosilicon compound having the structure represented by formula (Z): organosilicon compounds having four reactive groups in the molecule (tetrafunctional silanes), organosilicon compounds having two reactive groups in the molecule (bifunctional silanes), and organosilicon compounds having one reactive group in the molecule (monofunctional silanes). Examples include:

dimethyl diethoxysilane, tetraethoxysilane, hexamethyl disilazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ethoxymethoxyhydroxysilane and vinyl diethoxyhydroxysilane.

The content of the structure represented by formula (Z) in the monomers forming the organosilicon polymer is preferably at least 50 mol %, or more preferably at least 60 mol %.

A known silica fine particle may be used as the external additive B, which may be either a dry silica fine particle or wet silica fine particle. Preferably it is a wet silica fine particle obtained by a sol-gel method (hereunder also called sol-gel silica).

Although sol-gel silica is in a spherical, monodispersed state, some of the particles are also conjoined.

If the half width of the primary particle peak in a chart of the weight-based particle size distribution is not more than 25 nm, this means that there are fewer such conjoined particles, uniform attachment of the silica fine particle on the toner particle surface is increased, and greater flowability can be obtained.

The saturation water adsorption of the external additive B (silica fine particle) at 32.5° C., RH 80.0% is preferably from 0.4 to 3.0 mass %. If it is restricted to this range, the porous sol gel silica is less likely to adsorb moisture even in high-temperature, high-humidity environments, making it easier to maintain high charging performance. Consequently, high-quality images can be obtained with little fogging in the long term.

The method for manufacturing the sol-gel silica is explained below.

An alkoxysilane is hydrolyzed with a catalyst in an organic solvent containing water, and a condensation reaction is performed to obtain a silica sol suspension. The solvent is then removed from the silica sol suspension, which is then dried to obtain a silica fine particle.

The number-average particle diameter of the primary particles of the silica fine particle obtained by the sol-gel method can be controlled by controlling the reaction temperature in the hydrolysis and condensation reaction steps, the dripping speed of the alkoxysilane, the weight ratios of the water, organic solvent and catalyst, and the stirring speed.

The silica fine particle thus obtained is normally hydrophilic, and has many surface silanol groups. Consequently, it is desirable to hydrophobically treat the surface of the silica fine particle when using it as an external additive in a toner.

Examples of hydrophobic treatment methods include a method of removing the solvent from the silica sol suspension, drying the suspension and then treating it with a hydrophobic treatment agent, and a method of adding the hydrophobic treatment agent directly to the silica sol suspension, and treating it while drying it. From the standpoint of controlling the half width of the particle size distribution and the saturation water adsorption, a method of adding the hydrophobic treatment agent directly to the silica sol suspension is preferred.

Examples of the hydrophobic treatment agent include the following:

γ-(2-aminoethyl)aminopropyl trimethoxysilane, γ-(2-aminoethyl)aminopropyl methyl dimethoxysilane, γ-methacryloxypropyl trimethoxysilane, N-β-(N-vinylbenzylaminoethyl) γ-aminopropyl trimethoxysilane hydrochloride, hexamethyl disilazane, methyl trimethoxysilane, butyl trimethoxysilane, isobutyl trimethoxysilane, hexyl trimethoxysilane, octyl trimethoxysilane, decyl trimethoxysilane, dodecyl trimethoxysilane, phenyl trimethoxysilane, o-methylphenyl trimethoxysilane, p-methylphenyl trimethoxysilane, methyl triethoxysilane, butyl triethoxysilane, hexyl triethoxysilane, octyl triethoxysilane, decyl triethoxysilane, dodecyl triethoxysilane, phenyl triethoxysilane, o-methylphenyl triethoxysilane and p-methylphenyl triethoxysilane.

The silica fine particle may also be crushed in order to facilitate monodispersion of the silica fine particle on the toner particle surface and produce a stable spacer effect.

The external additive B (silica fine particle) preferably has an apparent density of from 150 to 300 g/L. If the apparent density of the external additive B is within this range, this means that the apparent density is extremely low, tight packing is unlikely, and there is plenty of air between the fine particles. Mixing of the toner particle and external additive B is therefore improved during the external addition step, and a uniform covered state is easily obtained. This is more obvious when the toner particle has a high average circularity, and the coverage rate tends to be higher in this case. The toner particles of the toner with the external additive are less likely to become tightly packed together as a result, and the attachment force between toner particles is reduced.

Methods for controlling the apparent density of the silica fine particle within the above range include adjusting the hydrophobic treatment in the silica sol suspension, the strength of the crushing treatment after hydrophobic treatment and the amount of the hydrophobic treatment. The number of the relatively large aggregates themselves can be reduced by uniform hydrophobic treatment. The relatively large aggregates contained in the dried silica fine particles can also be broken down into relatively small particles by adjusting the strength of the crushing treatment, thereby reducing the apparent density.

The external additive C (titanium oxide fine particle or strontium titanate fine particle) can also be surface treated to confer hydrophobicity.

Examples of the hydrophobic treatment agent include the following:

chlorosilanes such as methyl trichlorosilane, dimethyl dichlorosilane, trimethyl chlorosilane, phenyl trichlorosilane, diphenyl dichlorosilane, t-butyl dimethyl chlorosilane and vinyl trichlorosilane;

alkoxysilanes such as tetramethoxysilane, methyl trimethoxysilane, dimethyl dimethoxysilane, phenyl trimethoxysilane, diphenyl dimethoxysilane, o-methylphenyl trimethoxysilane, p-methylphenyl trimethoxysilane, n-butyl trimethoxysilane, i-butyl trimethoxysilane, hexyl trimethoxysilane, octyl trimethoxysilane, decyl trimethoxysilane, dodecyl trimethoxysilane, tetraethoxysilane, methyl triethoxysilane, dimethyl diethoxysilane, phenyl triethoxysilane, diphenyl diethoxysilane, i-butyl triethoxysilane, decyl triethoxysilane, vinyl triethoxysilane, γ-methacryloxypropyl trimethoxysilane, γ-glycidoxypropyl trimethoxysilane, γ-glycidoxypropyl methyl dimethoxysilane, γ-mercaptopropyl trimethoxysilane, γ-chloropropyl trimethoxysilane, γ-aminopropyl trimethoxysilane, γ-aminopropyl triethoxysilane, γ-(2-aminoethyl) aminopropyl trimethoxysilane and γ-(2-aminoethyl) aminopropyl methyl dimethoxysilane;

silazanes such as hexamethyl disilazane, hexaethyl disilazane, hexapropyl disilazane, hexabutyl disilazane, hexapentyl disilazane, hexahexyl disilazane, hexacyclohexyl disilazane, hexaphenyl disilazane, divinyl tetramethyl disilazane and dimethyl tetravinyl disilazane;

silicone oils such as dimethyl silicone oil, methyl hydrogen silicone oil, methylphenyl silicone oil, alkyl modified silicone oil, chloroalkyl modified silicone oil, chlorophenyl modified silicone oil, fatty acid modified silicone oil, polyether modified silicone oil, alkoxy modified silicone oil, carbinol modified silicone oil, amino modified silicone oil, fluorine modified silicone oil and terminal reactive silicone oil;

siloxanes such as hexamethyl cyclotrisiloxane, octamethyl cyclotetrasiloxane, decamethyl cyclopentasiloxane, hexamethyl disiloxane and octamethyl trisiloxane; and fatty acids and their metal salts, including long-chain fatty acids such as undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid and arachidonic acid, and salts of these fatty acids with metals such as zinc, iron, magnesium, aluminum, calcium, sodium and lithium.

Of these, an alkoxysilane, silazane or silicone oil is preferred because it is easy to perform hydrophobic treatment with these. One of these hydrophobic treatment agents may be used alone, or two or more may be used together.

The strontium titanate fine particle is explained in detail below.

The strontium titanate fine particle is more preferably a strontium titanate fine particle having a cubic particle shape, and having a perovskite crystal structure.

A strontium titanate fine particle having a cubic particle shape and having a perovskite crystal structure is generally manufactured in an aqueous solvent without a sintering step. It is therefore preferred because it is easy to obtain a uniform particle diameter.

X-ray diffraction measurement can be used to confirm that the crystal structure of the strontium titanate fine particle is a perovskite structure (a face-centered cubic lattice composed of three different elements).

Considering the developing properties and to control the triboelectric properties and triboelectric charge quantity depending on the environment, it is desirable to treat the surface of the strontium titanate fine particle.

The above hydrophobic treatment agent may be used as the surface treatment agent.

The surface treatment method may be a wet method in which the surface treatment agent and the like are dissolved and dispersed in a solvent, and the strontium titanate fine particle is added and stirred as the solvent is removed to treat the particle. It may also be a dry method in which the strontium titanate fine particle is mixed directly with a coupling agent and a fatty acid metal salt, and treated under stirring.

The method for manufacturing the toner particle is explained next.

The method for manufacturing the toner particle is not particularly limited, and a known method may be used, such as a kneading pulverization method or wet manufacturing method for example. A wet method is preferred from the standpoint of shape control and obtaining a uniform particle diameter. Wet methods include suspension polymerization methods, dissolution suspension methods, emulsion polymerization and aggregation methods, and emulsion aggregation methods, and it is preferred to use an emulsion aggregation method.

In emulsion aggregation methods, a fine particle of a binder resin and a fine particle of another material such as a colorant as necessary are dispersed and mixed in an aqueous medium containing a dispersion stabilizer. A surfactant may also be added to this aqueous medium. A flocculant is then added to aggregate the mixture until the desired toner particle size is reached, and the resin fine particles are also melt adhered together either after or during aggregation. Shape control with heat may also be performed as necessary in this method to form a toner particle.

The fine particle of the binder resin here may be a composite particle formed as a multilayer particle comprising two or more layers composed of different resins. For example, this can be manufactured by an emulsion polymerization method, mini-emulsion polymerization method, phase inversion emulsion method or the like, or by a combination of multiple manufacturing methods.

When the toner contains an internal additive such as a colorant, the colorant may be included in the resin fine particle, or a dispersion of an internal additive fine particle consisting solely of the internal additive can be prepared separately, and the internal additive fine particle can then by aggregated together with the resin fine particle.

Resin fine particles with different compositions may also be added at different times during aggregation, and aggregated to prepare a toner particle composed of layers with different compositions.

The following may be used as the dispersion stabilizer:

inorganic dispersion stabilizers such as tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

Other examples include organic dispersion stabilizers such as polyvinyl alcohol, gelatin, methyl cellulose, methyl hydroxypropyl cellulose, ethyl cellulose, carboxymethyl cellulose sodium salt, and starch.

A known cationic surfactant, anionic surfactant or nonionic surfactant may be used as the surfactant.

Specific examples of cationic surfactants include dodecyl ammonium bromide, dodecyl trimethylammonium bromide, dodecylpyridinium chloride, dodecylpyridinium bromide, hexadecyltrimethyl ammonium bromide and the like.

Specific examples of nonionic surfactants include dodecylpolyoxyethylene ether, hexadecylpolyoxyethylene ether, nonylphenylpolyoxyethylene ether, lauryl polyoxyethylene ether, sorbitan monooleate polyoxyethylene ether, styrylphenyl polyoxyethylene ether, monodecanoyl sucrose and the like.

Specific examples of anionic surfactants include aliphatic soaps such as sodium stearate and sodium laurate, and sodium lauryl sulfate, sodium dodecylbenzene sulfonate, sodium polyoxyethylene (2) lauryl ether sulfate and the like.

The binder resin constituting the toner is explained next.

Preferred examples of the binder resin include vinyl resins, polyester resins and the like. Examples of vinyl resins, polyester resins and other binder resins include the following resins and polymers:

monopolymers of styrenes and substituted styrenes, such as polystyrene and polyvinyl toluene; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacryalte, polybutyl methacrylate, polvinyl acetate, polyethylene, polypropylene, polvinyl butyral, silicone resin, polyamide resin, epoxy resin, polyacrylic resin, rosin, modified rosin, terpene resin, phenol resin, aliphatic or alicyclic hydrocarbon resins and aromatic petroleum resins. These binder resins may be used individually or mixed together.

The binder resin preferably contains carboxyl groups, and is preferably a resin manufactured using a polymerizable monomer containing a carboxyl group. Examples include vinylic carboxylic acids such as acrylic acid, methacrylic acid, α-ethylacrylic acid and crotonic acid; unsaturated dicarboxylic acids such as fumaric acid, maleic acid, citraconic acid and itaconic acid; and unsaturated dicarboxylic acid monoester derivatives such as monoacryloyloxyethyl succinate ester, monomethacryloyloxyethyl succinate ester, monoacryloyloxyethyl phthalate ester and monomethacryloyloxyethyl phthalate ester.

Polycondensates of the carboxylic acid components and alcohol components listed below may be used as the polyester resin. Examples of carboxylic acid components include terephthalic acid, isophthalic acid, phthalic acid, fumaric acid, maleic acid, cyclohexanedicarboxylic acid and trimellitic acid. Examples of alcohol components include bisphenol A, hydrogenated bisphenols, bisphenol A ethylene oxide adduct, bisphenol A propylene oxide adduct, glycerin, trimethyloyl propane and pentaerythritol.

The polyester resin may also be a polyester resin containing a urea group. Preferably the terminal and other carboxyl groups of the polyester resins are not capped.

To control the molecular weight of the binder resin constituting the toner particle, a crosslinking agent may also be added during polymerization of the polymerizable monomers.

Examples include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinyl benzene, bis (4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.), and these with methacrylate substituted for the acrylate.

The added amount of the crosslinking agent is preferably from 0.001 to 15.000 mass parts per 100 mass parts of the polymerizable monomers.

The toner particle may also contain a release agent. For example, it is easy to obtain a plasticization effect with an ester wax having a melting point of from 60° C. to 90° C. because the wax is highly compatible with the binder resin.

Examples of the ester wax include waxes having fatty acid esters as principal components, such as carnauba wax and montanic acid ester wax; those obtained by deoxidizing part or all of the oxygen component from the fatty acid ester, such as deoxidized carnauba wax; hydroxyl group-containing methyl ester compounds obtained by hydrogenation or the like of vegetable oils and fats; saturated fatty acid monoesters such as stearyl stearate and behenyl behenate; diesterified products of saturated aliphatic dicarboxylic acids and saturated fatty alcohols, such as dibehenyl sebacate, distearyl dodecanedioate and distearyl octadecanedioate; and diesterified products of saturated aliphatic diols and saturated aliphatic monocarboxylic acids, such as nonanediol dibehenate and dodecanediol distearate.

Of these waxes, it is desirable to include a bifunctional ester wax (diester) having two ester bonds in the molecular structure.

A bifunctional ester wax is an ester compound of a dihydric alcohol and an aliphatic monocarboxylic acid, or an ester compound of a divalent carboxylic acid and a fatty monoalcohol.

Specific examples of the aliphatic monocarboxylic acid include myristic acid, palmitic acid, stearic acid, arachidic acid, behenic acid, lignoceric acid, cerotic acid, montanic acid, melissic acid, oleic acid, vaccenic acid, linoleic acid and linolenic acid.

Specific examples of the fatty monoalcohol include myristyl alcohol, cetanol, stearyl alcohol, arachidyl alcohol, behenyl alcohol, tetracosanol, hexacosanol, octacosanol and triacontanol.

Specific examples of the divalent carboxylic acid include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecaendioic acid, tetradecanedioic acid, hexadecanedioic acid, octadecanedioic acid, eicosanedioic acid, phthalic acid, isophthalic acid, terephthalic acid and the like.

Specific examples of the dihydric alcohol include ethylene glycol, propylene glycol, 1,3-propanediol, 1,4-butanediol, 1,5-pentanediol, 1,6-hexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentyl glycol, 1,4-cyclohexane dimethanol, spiroglycol, 1,4-phenylene glycol, bisphenol A, hydrogenated bisphenol A and the like.

Other release agents that can be used include petroleum waxes such as paraffin wax, microcrystalline wax and petrolatum, and their derivatives; montanic wax and its derivatives, hydrocarbon waxes obtained by the Fischer-Tropsch method and their derivatives, polyolefin waxes such as polyethylene and polypropylene and their derivatives, natural waxes such as carnauba wax and candelilla wax and their derivatives, higher fatty alcohols, and fatty acids such as stearic acid and palmitic acid.

The content of the release agent is preferably from 5.0 to 20.0 mass parts per 100.0 mass parts of the binder resin or polymerizable monomers.

A colorant may also be included in the toner. The colorant is not specifically limited, and the following known colorants may be used.

Examples of yellow pigments include yellow iron oxide, Naples yellow, naphthol yellow S, Hansa yellow G, Hansa yellow 10G, benzidine yellow G, benzidine yellow GR, quinoline yellow lake, permanent yellow NCG, condensed azo compounds such as tartrazine lake, isoindolinone compounds, anthraquinone compounds, azo metal complexes, methine compounds and allylamide compounds. Specific examples include:

C.I. pigment yellow 12, 13, 14, 15, 17, 62, 74, 83, 93, 94, 95, 109, 110, 111, 128, 129, 147, 155, 168 and 180.

Examples of red pigments include red iron oxide, permanent red 4R, lithol red, pyrazolone red, watching red calcium salt, lake red C, lake red D, brilliant carmine 6B, brilliant carmine 3B, eosin lake, rhodamine lake B, condensed azo compounds such as alizarin lake, diketopyrrolopyrrole compounds, anthraquinone compounds, quinacridone compounds, basic dye lake compounds, naphthol compounds, benzimidazolone compounds, thioindigo compound and perylene compounds. Specific examples include:

C.I. pigment red 2, 3, 5, 6, 7, 23, 48:2, 48:3, 48:4, 57:1, 81:1, 122, 144, 146, 166, 169, 177, 184, 185, 202, 206, 220, 221 and 254.

Examples of blue pigments include alkali blue lake, Victoria blue lake, phthalocyanine blue, metal-free phthalocyanine blue, phthalocyanine blue partial chloride, fast sky blue, copper phthalocyanine compounds such as indathrene blue BG and derivatives thereof, anthraquinone compounds and basic dye lake compounds. Specific examples include:

C.I. pigment blue 1, 7, 15, 15:1, 15:2, 15:3, 15:4, 60, 62 and 66.

Examples of black pigments include carbon black and aniline black. These colorants may be used individually, or as a mixture, or in a solid solution.

The content of the colorant is preferably from 3.0 mass parts to 15.0 mass parts per 100.0 mass parts of the binder resin.

The toner particle may also contain a charge control agent. A known charge control agent may be used. A charge control agent that provides a rapid charging speed and can stably maintain a uniform charge quantity is especially desirable.

Examples of charge control agents for controlling the negative charge properties of the toner particle include:

organic metal compounds and chelate compounds, including monoazo metal compounds, acetylacetone metal compounds, aromatic oxycarboxylic acids, aromatic dicarboxylic acids, and metal compounds of oxycarboxylic acids and dicarboxylic acids. Other examples include aromatic oxycarboxylic acids, aromatic mono- and polycarboxylic acids and their metal salts, anhydrides and esters, and phenol derivatives such as bisphenols and the like. Further examples include urea derivatives, metal-containing salicylic acid compounds, metal-containing naphthoic acid compounds, boron compounds, quaternary ammonium salts and calixarenes.

Meanwhile, examples of charge control agents for controlling the positive charge properties of the toner particle include nigrosin and nigrosin modified with fatty acid metal salts; guanidine compounds; imidazole compounds; quaternary ammonium salts such as tributylbenzylammonium-1-hydroxy-4-naphthosulfonate salt and tetrabutylammonium tetrafluoroborate, onium salts such as phosphonium salts that are analogs of these, and lake pigments of these; triphenylmethane dyes and lake pigments thereof (using phosphotungstic acid, phosphomolybdic acid, phosphotungstenmolybdic acid, tannic acid, lauric acid, gallic acid, ferricyanic acid or a ferrocyan compound or the like as the laking agent); metal salts of higher fatty acids; and resin charge control agents.

One charge control agent alone or a combination of two or more kinds may be included.

The content of the charge control agent is preferably from 0.01 to 10.00 mass parts per 100.00 mass parts of the binder resin or polymerizable monomers.

The methods for measuring the physical properties in the present invention are explained below.

Organosilicon Polymer Fine Particle Identification Method

The organosilicon polymer fine particle contained in the toner can be identified by a method combining shape observation by SEM with elemental analysis by EDS.

The toner is observed in a field enlarged to a maximum magnification of 50000× with a scanning electron microscope (trade name: "S-4800", Hitachi, Ltd.). The microscope is focused on the toner particle surface, and the external additive is observed. Each particle of the external additive is subjected to EDS analysis to determine whether or not the analyzed particle is an organosilicon polymer fine particle based on the presence or absence of an Si element peak.

When the toner contains both an organosilicon polymer fine particle and a silica fine particle, the ratio of the elemental contents (atomic %) of Si and O (Si/O ratio) is compared with that of a standard product to identify the organosilicon polymer fine particle.

Standard products of both the organosilicon polymer fine particle and silica fine particle are subjected to EDS analysis under the same conditions, to determine the elemental contents (atomic %) of Si and O.

The Si/O ratio of the organosilicon polymer fine particle is given as A, and the Si/O ratio of the silica fine particle as B. Measurement conditions are selected such that A is significantly larger than B.

Specifically, the standard products are measured 10 times under the same conditions, and arithmetic means are obtained for both A and B. The measurement conditions are selected so that the arithmetic means yield an A/B ratio greater than 1.1.

If the Si/O ratio of an evaluated fine particle is closer to A than to [(A+B)/2], the fine particle is judged to be an organosilicon polymer fine particle.

Tospearl 120A (Momentive Performance Materials Japan LLC) is used as the standard product for the organosilicon polymer fine particle, and HDK V15 (Asahi Kasei Corporation) as the standard product for the organosilicon polymer fine particle.

Method for Measuring Number-average Particle Diameters of Primary Particles of Organosilicon Polymer Fine Particle and Silica Fine Particle Measurement is performed by a combination of scanning electron microscopy (trade name: "S-4800", Hitachi, Ltd.) and elemental analysis by energy dispersive X-ray analysis (EDS).

Using a combination of SEM and the EDS elemental analysis methods described above, randomly selected fine particles are photographed in a field enlarged to a maximum magnification of 50,000×.

100 organosilicon polymer fine particles and silica fine particles are selected randomly from the photographed images, the long diameters of the primary particles of the fine particles of interest are measured, and the calculated averages are given as the number-average particle diameters.

The observation magnification is adjusted appropriately according to the sizes of the organosilicon polymer fine particle and the silicon fine particle.

Method for Measuring Shape Factors SF-1 of Organosilicon Polymer Fine Particle and Silica Fine Particle These were calculated as follows using a scanning electron microscope (SEM) "S-4800" (Hitachi, Ltd.) in combination with elemental analysis by energy dispersive X-ray analysis (EDS).

Using a combination of SEM and the EDS elemental analysis methods described above, fine particles were photographed at random in a field enlarged to a magnification of 100,000× to 200,000×.

100 organosilicon polymer fine particles and silica fine particles are selected randomly from the photographed images.

The perimeters and areas of the primary particles of the 100 fine particles are measured with "Image-Pro Plus 5.1J" image processing software (Media Cybernetics, Inc.), and the SF-1 is calculated according to the following formula. The calculated average is given as the SF-1.

$$SF\text{-}1=(\text{maximum length of particle})^2/\text{particle area}\times\pi/4\times 100$$

Method for Identifying Compositions and Ratios of Constituent Compounds of Organosilicon Polymer Fine Particle The compositions and ratios of the constituent compounds of the organosilicon polymer fine particle contained in the toner are identified by NMR.

When the toner contains a silica fine particle in addition to the organosilicon polymer fine particle, 1 g of the toner is dissolved and dispersed in 31 g of chloroform in a vial. This is dispersed for 30 minutes with an ultrasound homogenizer to prepare a liquid dispersion.

Ultrasonic processing unit: VP-050 ultrasound homogenizer (Taitec Corporation)

Microchip: Step microchip, tip diameter φ 2 mm

Microchip tip position: Center of glass vial and 5 mm above bottom of vial

Ultrasound conditions: Intensity 30%, 30 minutes

Ultrasound is applied while cooling the vial with ice water so that the temperature of the dispersion does not rise.

The dispersion is transferred to a swing rotor glass tube (50 mL), and centrifuged for 30 minutes under conditions of 58.33 $S^{-1}$ with a centrifuge (H-9R; Kokusan Co., Ltd.). After centrifugation, the glass tube contains silica fine particles with heavy specific gravity in the lower layer. The chloroform solution containing organic silica polymer fine particles in the upper layer is collected, and the chloroform is removed by vacuum drying (40° C./24 hours) to prepare a sample.

Using this sample or the organosilicon polymer fine particles, the abundance ratios of the constituent compounds of the organosilicon polymer fine particle and the ratio of T3 unit structures in the organosilicon polymer fine particle are measured and calculated by solid $^{29}$Si-NMR.

The hydrocarbon group represented by $R^a$ above is confirmed by $^{13}$C-NMR.

$^{13}$C-NMR (Solid) Measurement Conditions

Unit: JNM-ECX500II (JEOL RESONANCE Inc.)

Sample tube: 3.2 mm φ

Sample: sample or the organosilicon polymer fine particles

Measurement temperature: Room temperature

Pulse mode: CP/MAS

Measurement nuclear frequency: 123.25 MHz ($^{13}$C)

Standard substance: Adamantane (external standard: 29.5 ppm)

Sample rotation: 20 kHz

Contact time: 2 ms

Delay time: 2 s

Number of integrations: 1024

In this method, the hydrocarbon group represented by $R^a$ above is confirmed based on the presence or absence of signals attributable to methyl groups (Si—$CH_3$), ethyl groups (Si—$C_2H_5$), propyl groups (Si—$C_3H_7$), butyl groups (Si—$C_4H_9$), pentyl groups (Si—$C_5H_{11}$), hexyl groups (Si—$C_6H_{13}$) or phenyl groups (Si—$C_6H_5$—) bound to silicon atoms.

In solid $^{29}$Si-NMR, on the other hand, peaks are detected in different shift regions depending on the structures of the functional groups binding to Si in the constituent compounds of the organosilicon polymer fine particle.

The structures binding to Si can be specified by using standard samples to specify each peak position. The abundance ratio of each constituent compound can also be calculated from the resulting peak areas. The ratio of the peak area of T3 unit structures relative to the total peak area can also be determined by calculation.

The measurement conditions for solid $^{29}$Si-NMR are as follows for example.

Unit: JNM-ECX5002 (JEOL RESONANCE Inc.)

Temperature: Room temperature

Measurement method: DDMAS method, $^{29}$Si 45°

Sample tube: Zirconia 3.2 mm φ

Sample: Packed in sample tube in powder form

Sample rotation: 10 kHz

Relaxation delay: 180 s

Scan: 2,000

After this measurement, the peaks of the multiple silane components having different substituents and linking groups in the organosilicon polymer fine particle are separated by curve fitting into the following X1, X2, X3 and X4 structures, and the respective peak areas are calculated.

The X3 structure below is the T3 unit structure according to the present invention.

X1 structure: $(Ri)(Rj)(Rk)SiO_{1/2}$ (A1)

X2 structure: $(Rg)(Rh)Si(O_{1/2})_2$ (A2)

X3 structure: $RmSi(O_{1/2})_3$ (A3)

X4 structure: $Si(O_{1/2})_4$ (A4)

X1 structure:

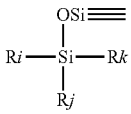

(A1)

X2 structure:

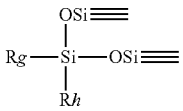

(A2)

X3 structure:

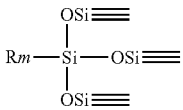

(A3)

X4 structure:

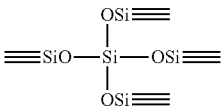

(A4)

Ri, Rj, Rk, Rg, Rh and Rm in formulae (A1), (A2) and (A3) represent halogen atoms, hydroxyl groups, acetoxy groups, alkoxy groups or organic groups such as $C_{1-6}$ hydrocarbon groups bound to silicon.

When a structure needs to be confirmed in more detail, it can be identified from $^{1}$H-NMR measurement results in addition to the above $^{13}$C-NMR and $^{29}$Si-NMR measurement results.

Method for Assaying Organosilicon Polymer Fine Particle and Silica Fine Particle Contained in Toner The toner is dispersed in chloroform as described above, the organosilicon polymer fine particle and silica fine particle are then separated by centrifugation according to their difference in specific gravities to obtain samples of each, and the content of the organosilicon polymer fine particle or silica fine particle is determined.

The pressed toner is first measured by fluorescence X-ray, and the silicon content of the toner is determined by analysis using the calibration curve method, FP method or the like.

Next, the structures of each of the constituent compounds forming the organosilicon polymer fine particle and the silica fine particle as necessary are specified by solid $^{29}$Si-NMR and pyrolysis GC/MS, and the silicon contents of the organosilicon polymer fine particle and silica fine particle are determined. The content of the organosilicon polymer fine particle or silica fine particle in the toner is then determined by calculation based on the relationship between the silicon content of the toner as determined by fluorescence X-ray and the silicon contents of the organosilicon polymer fine particle and silica fine particle as determined by solid $^{29}$Si-NMR and pyrolysis GC/MS.

Method for Measuring Fixing Rate of Organosilicon Polymer Fine Particle or Silica Fine Particle to Toner Particle by Washing Method Washing Step 20 g of "Contaminon N" (a 30 mass % aqueous solution of a pH 7 neutral detergent for washing precision instruments, comprising a nonionic surfactant, an anionic surfactant and an organic builder) is measured into a 50 mL capacity vial, and mixed with 1 g of toner.

The vial is set into "KM Shaker" (model V.SX, IWAKI CO., LTD.), and shaken for 120 seconds with the speed set to 50. Depending on the fixed state of the organosilicon polymer fine particle or silica fine particle, this serves to move the organosilicon polymer fine particle or silica fine particle from the toner particle surface into the dispersion.

The toner and the organosilicon polymer fine particle or silica fine particle that has moved into the supernatant are then separated with a centrifuge (H-9R; Kokusan Co., Ltd.) (5 minutes at 16.67 $S^{-1}$).

The precipitated toner is dried by vacuum drying (40° C./24 hours), and used as a washed toner.

Next, toner that has not undergone a washing step (unwashed toner) and the toner obtained from the washing step above (washed toner) are photographed using a Hitachi S-4800 high-resolution field emission scanning electron microscope (Hitachi High-Technologies Corporation).

The resulting toner surface images are then analyzed with Image-Pro Plus ver. 5.0 image analysis software (Nippon Roper K.K.) to calculate the coverage rate.

The S-4800 imaging conditions are as follows.

(1) Sample Preparation

Conductive paste is thinly applied to a sample stand (15 mm×6 mm aluminum sample stand), and the toner is then blown onto this. This is then air blown to remove excess toner from the sample stand and thoroughly dry the sample. The sample stand is set in a sample holder, and the sample stand height is adjusted to 36 mm with a sample height gauge.

(2) Setting S-4800 Observation Conditions

When measuring the coverage rate, elemental analysis is first performed by energy dispersive X-ray analysis (EDS) to distinguish the organosilicon polymer fine particle or silica fine particle on the toner particle surface.

Liquid nitrogen is injected to overflowing into an anti-contamination trap attached to the case of the S-4800, and left for 30 minutes. "PC-SEM" is started on the S-4800 to perform flushing (purification of FE chip electron source). The acceleration voltage display part of the control panel on the image is clicked, and the "Flushing" button is pressed to open a flushing performance dialog. Flushing is performed after confirming that the flushing strength is 2. The emission current due to flushing is confirmed to be 20 to 40 μA. The sample holder is inserted into the sample chamber of the S-4800 case. "Starting point" is pressed on the control panel to move the sample holder to the observation position.

The acceleration voltage display part is clicked to open an HV settings dialog, and the acceleration voltage is set to "1.1 kV" and the emission current to "20 μA". Signal selection is set to "SE" in the "Basic" tab of the operation panel, "Upper (U)" and "+BSE" are set as the SE detectors, and "L.A. 100" is selected in the selection box to the right of "+BSE" to set the mode to backscattered electron imaging. In the same "Basic" tab of the operations panel, the probe current of the electro-optical conditions block is set to "Normal", the focus mode to "UHR", and the WD to "4.5 mm". The "ON" button of the acceleration voltage display part of the control panel is pressed to apply acceleration voltage.

(3) Calculating Number-Average Particle Diameter (D1) of Toner

The magnification is set to 5,000-fold (5 k-fold) by dragging inside the magnification display part of the control panel. The "COARSE" focus knob on the operations panel is rotated, and the aperture alignment is adjusted once the image is somewhat focused. "Align" is clicked on the control panel to display an alignment dialog, and "Beam" is selected. The STIGMA/ALIGNMENT knob (X, Y) on the operations panel is rotated to move the displayed beam to the center of the concentric circles. "Aperture" is then selected, and the STIGMA/ALIGNMENT knob (X, Y) is rotated step by step to stop or minimize the movement of the image. The aperture dialog is closed, and the image is focused in autofocus. This operation is repeated twice to focus the image.

The particle diameters of 300 toner particles are then measured, and the number-average particle diameter (D1) is determined. The particle diameter of an individual particle is the maximum diameter when the toner particle is observed.

(4) Focal Point Adjustment

For a particle within ±0.1 μm of the number-average particle diameter (D1) obtained in (3), the magnification is set to 10,000-fold (10 k-fold) by dragging inside the magnification display part of the control panel with the center point of the maximum diameter aligned with the center of the measurement screen.

The "COARSE" focus knob on the operations panel is rotated, and the aperture alignment is adjusted once the image is somewhat focused. "Align" is clicked on the control panel to display an alignment dialog, and "Beam" is selected. The STIGMA/ALIGNMENT knob (X, Y) on the operations panel is rotated to move the displayed beam to the center of the concentric circles. "Aperture" is then selected, and the STIGMA/ALIGNMENT knob (X, Y) is rotated step by step to stop or minimize the movement of the image. The aperture dialog is closed, and the image is focused in autofocus. The magnification is then set to 50,000-fold (50 k-fold), and the focus knob and STIGMA/ALIGNMENT knob are used as before to adjust the focus, and the image is then focused again in autofocus. This operation is repeated to focus the image. Since the coverage rate measurement accuracy is likely to decline if the tilt angle of the observation surface is too great, surface tilt is eliminated as much as possible by selecting an observation surface that can be focused in its entirety during focus adjustment.

(5) Image Storage

The brightness is adjusted in ABC mode, and 640×480 pixel images are photographed and stored. The following analysis is then performed using these image files. One photograph is taken for each toner, and 25 toner particles are imaged.

(6) Image Analysis

The images obtained by the above methods are binarized with the following analysis software to calculate the coverage rate. At this time, the one screen is divided into twelve squares, and each is analyzed separately.

The analysis conditions for the Image-Pro Plus ver. 5.0 image analysis software are as follows. However, if an organosilicon polymer fine particle with a particle diameter of less than 30 nm or more than 300 nm (when measuring the coverage rate by the organosilicon polymer fine particle) or a silica fine particle with a particle diameter of less than 100 nm or more than 300 nm (when measuring the coverage rate by the silica fine particle) is present in a divided section, the coverage rate is not measured in that section.

Image-Pro Plus 5.1J Software

"Measurement", "Count/size" and "Option" are selected in that order on the tool bar to set the binarization conditions. 8-connected is selected from the object extraction options, and smoothing is set to 0. Pre-selection, hole filling and envelope are not selected, and "Exclude borders" is set to "No". "Measurement item" is selected under "Measurement" in the tool bar, and 2 to $10^7$ is entered as the area selection range.

To calculate the coverage rate, a cubic region is delineated. The region area (C) is set to 24,000 to 26,000 pixels. "Process"—Binarization is performed automatically with binarization, and the sum (D) of the areas of regions without organosilicon polymer fine particles or silica fine particles is calculated.

The coverage rate is calculated by the following formula from the square region area C and the sum D of the areas of regions without organosilicon polymer fine particles or silica fine particles.

$$\text{Coverage rate (\%)} = 100 - (D/C \times 100)$$

The calculated average of all data is given as the coverage rate.

The respective coverage rates of the unwashed toner and the washed toner are then calculated.

"Coverage rate of washed toner"/"coverage rate of unwashed toner"×100 is given as the "fixing rate" in the present invention.

EXAMPLES

The invention is explained in more detail below based on examples and comparative examples, but the invention is in no way limited to these. Unless otherwise specified, parts and % in the examples are based on mass.

Toner manufacturing examples are explained.

Preparation of Binder Resin Particle Dispersion 89.5 parts of styrene, 9.2 parts of butyl acrylate, 1.3 parts of acrylic acid and 3.2 parts of n-lauryl mercaptane were mixed and dissolved. An aqueous solution of 1.5 parts of Neogen RK (DKS Co., Ltd.) in 150 parts of ion-exchange water was added and dispersed in this mixed solution.

This was then gently stirred for 10 minutes as an aqueous solution of 0.3 parts of potassium persulfate mixed with 10 parts of ion-exchange water was added.

After nitrogen purging, emulsion polymerization was performed for 6 hours at 70° C. After completion of polymerization, the reaction solution was cooled to room temperature, and ion-exchange water was added to obtain a binder resin particle dispersion with a volume-based median particle diameter of 0.2 μm and a solids concentration of 12.5 mass %.

Preparation of Release Agent Dispersion 100 parts of a release agent (behenyl behenate, melting point: 72.1° C.) and 15 parts of Neogen RK were mixed with 385 parts of ion-exchange water, and dispersed for about 1 hour with a JN100 wet jet mill (Jokoh Co., Ltd.) to obtain a release agent dispersion. The solids concentration of the release agent dispersion was 20 mass %.

Preparation of Colorant Dispersion 100 parts of carbon black "Nipex35 (Orion Engineered Carbons)" and 15 parts of Neogen RK were mixed with 885 parts of ion-exchange water, and dispersed for about 1 hour in a JN100 wet jet mill to obtain a colorant dispersion.

Preparation of Toner Particle 1

265 parts of the binder resin particle dispersion, 10 parts of the release agent dispersion and 10 parts of the colorant dispersion were dispersed with a homogenizer (IKA Japan K.K.: Ultra-Turrax T50).

The temperature inside the vessel was adjusted to 30° C. under stirring, and 1 mol/L hydrochloric acid was added to adjust the pH to 5.0. This was left for 3 minutes before initiating temperature rise, and the temperature was raised to 50° C. to produce aggregate particles. The particle diameter of the aggregate particles was measured under these conditions with a "Multisizer 3 Coulter Counter" (registered trademark, Beckman Coulter, Inc.). Once the weight-average particle diameter reached 6.2 μm, 1 mol/L sodium hydroxide aqueous solution was added to adjust the pH to 8.0 and arrest particle growth.

The temperature was then raised to 95° C. to fuse and spheroidize the aggregate particles. Temperature lowering was initiated when the average circularity reached 0.980, and the temperature was lowered to 30° C. to obtain a toner particle dispersion 1.

Hydrochloric acid was added to adjust the pH of the resulting toner particle dispersion 1 to 1.5 or less, and the dispersion was stirred for 1 hour, left standing, and then subjected to solid-liquid separation in a pressure filter to obtain a toner cake.

This was made into a slurry with ion-exchange water, re-dispersed, and subjected to solid-liquid separation in the previous filter unit. Re-slurrying and solid-liquid separation were repeated until the electrical conductivity of the filtrate was not more than 5.0 μS/cm, to perform final solid-liquid separation and obtain a toner cake.

The resulting toner cake was dried with a Flash Jet air dryer (Seishin Enterprise Co., Ltd.). The drying conditions were a blowing temperature of 90° C. and a dryer outlet temperature of 40° C., with the toner cake supply speed adjusted according to the moisture content of the toner cake so that the outlet temperature did not deviate from 40° C. Fine and coarse powder was cut with a multi-division classifier using the Coanda effect, to obtain a toner particle 1. The toner particle 1 had a weight-average particle diameter (D4) of 6.3 μm, an average circularity of 0.980, and a glass transition temperature (Tg) of 57° C.

External Additive A: Manufacturing Example of Organosilicon Polymer Fine Particle A1

Step 1

360.0 parts of water were placed in a reactor equipped with a thermometer and a stirrer, and 15.0 parts of 5.0 mass % hydrochloric acid were added to obtain a uniform solution. This was stirred at 25° C. as 136.0 parts of methyl trimethoxysilane were added and stirred for 5 hours, after which the mixture was filtered to obtain a clear reaction solution containing a silanol compound or a partial condensate thereof.

Step 2

440.0 parts of water were placed in a reactor equipped with a thermometer, a stirrer and a dripping mechanism, and 17.0 parts of 10.0 mass % ammonia water were added to obtain a uniform solution.

This was stirred at 35° C. as 100.0 parts of the reaction solution obtained in Step 1 were dripped in over the course of 0.5 hours, and then stirred for 6 hours to obtain a suspension.

The resulting suspension was centrifuged to precipitate the particles, which were then removed and dried for 24 hours in a drier at 200° C. to obtain an organosilicon polymer fine particle A1.

The number-average particle diameter of the primary particles of the resulting organosilicon polymer fine particle A1 was 100 nm.

External Additive A: Manufacturing Examples of Organosilicon Polymer Fine Particles A2 to A6

Organosilicon polymer fine particles A2 to A6 were obtained as in the manufacturing example of the organosilicon polymer fine particle A1 except that the silane compound, reaction initiation temperature, added amount of ammonia water and reaction solution dripping time were changed as shown in Table 1. The physical properties of the resulting organosilicon polymer fine particles A2 to A6 are shown in Table 1.

TABLE 1

| Organosilicon polymer fine particle No. | Step 1 Water Parts | Step 1 Hydrochloric acid Parts | Step 1 Reaction temperature ° C. | Step 1 Silane compound A Name | Step 1 Silane compound A Parts |
|---|---|---|---|---|---|
| A1 | 360.0 | 15.0 | 25 | Methyl trimethoxysilane | 136.0 |
| A2 | 360.0 | 10.0 | 25 | Methyl trimethoxysilane | 136.0 |
| A3 | 360.0 | 20.0 | 25 | Methyl trimethoxysilane | 136.0 |
| A4 | 360.0 | 15.0 | 25 | Dimethyl dimethoxysilane | 136.0 |
| A5 | 360.0 | 8.0 | 25 | Methyl trimethoxysilane | 136.0 |
| A6 | 360.0 | 25.0 | 25 | Methyl trimethoxysilane | 136.0 |

| Organosilicon polymer fine particle No. | Step 2 Reaction solution obtained in Step 1 Parts | Step 2 Water Parts | Step 2 Ammonia water Parts | Step 2 Reaction initiation temperature ° C. | Step 2 Dripping time hours | Number-average particle diameter of primary particles (nm) | Shape factor SF-1 | T |
|---|---|---|---|---|---|---|---|---|
| A1 | 100.0 | 440.0 | 17.0 | 35 | 0.5 | 100 | 105 | 1.00 |
| A2 | 100.0 | 440.0 | 10.0 | 45 | 2.0 | 35 | 105 | 1.00 |
| A3 | 100.0 | 500.0 | 20.0 | 30 | 0.3 | 290 | 105 | 1.00 |
| A4 | 100.0 | 440.0 | 17.0 | 35 | 0.5 | 100 | 105 | 0.00 |
| A5 | 100.0 | 440.0 | 8.0 | 50 | 3.0 | 20 | 105 | 1.00 |
| A6 | 100.0 | 440.0 | 25.0 | 30 | 0.2 | 320 | 105 | 1.00 |

In the table, T represents the ratio of the area of a peak derived from silicon having a T3 unit structure to the total area of peaks derived from all silicon elements contained in the organosilicon polymer fine particle.

External Additive B: Manufacturing Examples of Silica Fine Particles B1 to B8

A silica fine particle B1 was manufactured as follows.

150 parts of 5% ammonia water was added and mixed in a 1.5 L glass reaction container equipped with a stirrer, a dripping nozzle and a thermometer, to obtain an alkali catalyst solution. This alkali catalyst solution was adjusted to 50° C., and stirred as 100 parts of tetraethoxysilane and 50 parts of 5% ammonia water were dripped in simultaneously and reacted for 8 hours to obtain a silica fine particle dispersion. The resulting silica fine particle dispersion was then dried by spray drying to obtain a silica fine particle.

Silica fine particles B2 to B8 were obtained in the same way as the silica fine particle B1 except that the formulations were changed as shown in Table 2. The manufacturing conditions and physical properties are shown in Table 2.

TABLE 2

| Silica fine particle No. | Composition | Temperature of catalyst solution (° C.) | Amount of 5% ammonia water (parts) | Number-average particle diameter of primary particles (nm) | Shape factor SF-1 |
|---|---|---|---|---|---|
| B1 | Silica | 50 | 150 | 200 | 105 |
| B2 | Silica | 65 | 150 | 100 | 105 |
| B3 | Silica | 35 | 150 | 300 | 105 |
| B4 | Silica | 70 | 150 | 80 | 105 |
| B5 | Silica | 30 | 150 | 320 | 105 |
| B6 | Silica | 50 | 120 | 200 | 112 |
| B7 | Silica | 50 | 110 | 200 | 116 |
| B8 | Silica | 85 | 200 | 15 | 105 |

Manufacturing Example of Toner 1

External Addition Step 100.00 parts of the toner particle 1 and 1.00 part of the silica fine particle B1 as additive 1 were placed in a Henschel mixer (Nippon Coke & Engineering Co., Ltd. FM10C) with 7° C. water in the jacket.

3.00 parts of the organosilicon polymer fine particle A1 as additive 2 were then added to the Henschel mixer, and once the water temperature in the jacket had stabilized at 7° C.±1° C., this was mixed for 10 minutes with a 38 m/sec peripheral speed of the rotating blade, to obtain a toner mixture 1.

The amount of water passing through the jacket was adjusted appropriately during this process so that the temperature inside the Henschel mixer tank did not exceed 25° C.

The resulting toner mixture 1 was sieved with a 75 μm mesh to obtain a toner 1. The external addition conditions of the external additives are shown in Table 3, and the physical properties of the toner 1 in Table 4.

Preparation Examples of Toners 2 to 18 and Comparative Toners 1 to 7

Toners 2 to 18 and comparative toners 1 to 7 were obtained as in the manufacturing example of the toner 1 except that the conditions were changed as shown in Table 4. The external addition conditions of the external additives are shown in Table 3, and the physical properties of the resulting toners in Table 4.

When preparing toner 6 and comparative toner 6, the mixture was mixed for the time shown in Table 3 after addition of the additive 1 as a first stage external addition, and the additive 2 was then added to perform a second stage external addition.

TABLE 3

| | External additive | | | | External addition mixing time (minutes) | |
|---|---|---|---|---|---|---|
| Toner No. | Additive 1 | Parts | Additive 2 | Parts | Additive 1 | Additive 2 |
| 1 | B1 | 1.00 | A1 | 3.00 | 0 | 10 |
| 2 | B1 | 1.00 | A2 | 3.00 | 0 | 10 |

TABLE 3-continued

| Toner No. | External additive | | | | External addition mixing time (minutes) | |
|---|---|---|---|---|---|---|
| | Additive 1 | Parts | Additive 2 | Parts | Additive 1 | Additive 2 |
| 3 | B1 | 1.00 | A3 | 3.00 | 0 | 10 |
| 4 | B2 | 1.00 | A1 | 3.00 | 0 | 10 |
| 5 | B3 | 1.00 | A1 | 3.00 | 0 | 10 |
| 6 | A1 | 3.00 | B1 | 1.00 | 10 | 10 |
| 7 | B1 | 1.00 | A1 | 3.00 | 0 | 8 |
| 8 | B1 | 1.00 | A1 | 0.30 | 0 | 10 |
| 9 | B1 | 1.00 | A1 | 0.60 | 0 | 10 |
| 10 | B1 | 1.00 | A1 | 5.50 | 0 | 10 |
| 11 | B1 | 1.00 | A1 | 6.50 | 0 | 10 |
| 12 | B1 | 0.05 | A1 | 3.00 | 0 | 10 |
| 13 | B1 | 0.15 | A1 | 3.00 | 0 | 10 |
| 14 | B1 | 2.50 | A1 | 3.00 | 0 | 10 |
| 15 | B1 | 3.50 | A1 | 3.00 | 0 | 10 |
| 16 | B6 | 1.00 | A1 | 3.00 | 0 | 10 |
| 17 | B7 | 1.00 | A1 | 3.00 | 0 | 10 |
| 18 | B1 | 1.00 | A4 | 3.00 | 0 | 10 |
| Comparative 1 | B1 | 1.00 | B8 | 3.00 | 0 | 10 |
| Comparative 2 | B1 | 1.00 | A5 | 3.00 | 0 | 10 |
| Comparative 3 | B1 | 1.00 | A6 | 3.00 | 0 | 10 |
| Comparative 4 | B4 | 1.00 | A1 | 3.00 | 0 | 10 |
| Comparative 5 | B5 | 1.00 | A1 | 3.00 | 0 | 10 |
| Comparative 6 | A1 | 3.00 | B1 | 1.00 | 20 | 10 |
| Comparative 7 | B1 | 1.00 | A1 | 3.00 | 0 | 5 |

TABLE 4

| | Toner No. | External additive fixing rate (%) | | External additive content (%) | |
|---|---|---|---|---|---|
| | | Additive 1 | Additive 2 | Additive 1 | Additive 2 |
| Example 1 | 1 | 40 | 10 | 0.96 | 2.88 |
| Example 2 | 2 | 40 | 10 | 0.96 | 2.88 |
| Example 3 | 3 | 40 | 10 | 0.96 | 2.88 |
| Example 4 | 4 | 40 | 10 | 0.96 | 2.88 |
| Example 5 | 5 | 40 | 10 | 0.96 | 2.88 |
| Example 6 | 6 | 25 | 40 | 2.88 | 0.96 |
| Example 7 | 7 | 35 | 10 | 0.96 | 2.88 |
| Example 8 | 8 | 40 | 10 | 0.99 | 0.30 |
| Example 9 | 9 | 40 | 10 | 0.98 | 0.59 |
| Example 10 | 10 | 40 | 10 | 0.94 | 5.16 |
| Example 11 | 11 | 40 | 10 | 0.93 | 6.05 |
| Example 12 | 12 | 40 | 10 | 0.05 | 2.91 |
| Example 13 | 13 | 40 | 10 | 0.15 | 2.91 |
| Example 14 | 14 | 40 | 10 | 2.37 | 2.84 |
| Example 15 | 15 | 40 | 10 | 3.29 | 2.82 |
| Example 16 | 16 | 40 | 10 | 0.96 | 2.88 |
| Example 17 | 17 | 40 | 10 | 0.96 | 2.88 |
| Example 18 | 18 | 40 | 10 | 0.96 | 2.88 |
| Comparative Example 1 | Comparative 1 | 65 | 65 | 0.96 | 2.88 |
| Comparative Example 2 | Comparative 2 | 40 | 10 | 0.96 | 2.88 |
| Comparative Example 3 | Comparative 3 | 40 | 10 | 0.96 | 2.88 |
| Comparative Example 4 | Comparative 4 | 40 | 10 | 0.96 | 2.88 |
| Comparative Example 5 | Comparative 5 | 40 | 10 | 0.96 | 2.88 |
| Comparative Example 6 | Comparative 6 | 35 | 40 | 2.88 | 0.96 |
| Comparative Example 7 | Comparative 7 | 25 | 10 | 0.96 | 2.88 |

Example 1

The toner 1 was evaluated as follows. The evaluation results are shown in Table 5.

A modified LBP712Ci (Canon Inc.) was used as the evaluation unit. The process speed of the main unit was modified to 300 mm/sec, and the necessary adjustments were made so that image formation was possible under these conditions. The toner was removed from a black cartridge, which was then filled with 300 g of the toner 1.

Evaluation of Transferability (Transfer Efficiency)

Transfer efficiency is a measure of transferability that shows what percentage of the toner developed on the photosensitive drum is transferred to the intermediate transfer belt.

Transfer efficiency was evaluated by forming a solid image continuously on a recording medium. After 3,000 sheets of the solid image were formed, the toner transferred to the intermediate transfer belt and the residual toner remaining on the photosensitive drum after transfer were peeled off with polyester adhesive tape.

The peeled adhesive tape was affixed to paper, and the density when only adhesive tape was affixed to paper was subtracted from the resulting toner density to calculate the density differences for both.

The transfer efficiency is the ratio of the toner density difference on the intermediate transfer belt given 100 as the sum of both toner density differences, and transfer efficiency is better the greater this percentage.

Measurement was performed in a low-temperature, low-humidity environment (15° C., 15% RH), and transfer efficiency after formation of the 3,000 images above was evaluated based on the following standard.

The toner density was measured with an X-Rite color reflection densitometer (500 series).

Canon Color Laser Copier paper (A4: 81.4 g/m$^2$, used here and below unless otherwise specified) was used as the evaluation paper.

Evaluation Standard

A: Transfer efficiency at least 98%

B: Transfer efficiency from 95% to less than 98%

C: Transfer efficiency from 90% to less than 95%

D: Transfer efficiency less than 90%

Evaluation of Flowability and Durability (Solid Followability)

Solid followability in high-temperature, high-humidity environments was evaluated by the following methods.

A cartridge filled with the toner 1 and the main printer body were left for at least 24 hours in a high-temperature, high-humidity environment (32.5° C., 80% RH). Three sheets of an all-black image as a sample image were then output continuously, and the third image of the resulting all-black images was evaluated visually to evaluate solid followability.

To evaluate durability, 10,000 sheets were output continuously in one day with a print percentage of 1%, and left in the machine for one day, after which solid followability was evaluated. The evaluation standard was as follows.

This evaluation is known to yield better results the greater the flowability of the toner. An evaluation was performed after every 10,000 sheets, and evaluation was performed continuously up to 30,000 sheets.

Evaluation Standard

A: Uniform image density without irregularities

B: Some slight irregularities in image density, but at a level that is not a problem for use C: Some irregularities in image density, but at a level that is not a problem for use D: Irregularities in image density, uniform solid image not obtained Evaluating Contamination of Member (Black Dot Images)

Black dot images are black spots 1 to 2 mm in size that occur when the latent image bearing member (photosensitive body) is contaminated by an external additive, and this image defect is easily observed when a halftone image is output.

Black dot images were evaluated by the following methods.

The cartridge used in the above 30,000-sheet test for evaluating durability was left standing for one day in a low-temperature, low-humidity environment (15° C., 10% RH) and used in the evaluation.

Using the above cartridge, a half-tone image was output in a low-temperature, low-humidity environment, and the presence or absence of black speckles was observed. The evaluation standard was as follows.

Evaluation Standard

A: No problems on image, no melt adhering material observed on photosensitive body under microscope.

B: No problems on image, slight melt adhering material observed on photosensitive body under microscope.

C: Slight black dot image observed on part of image, slight melt adhering material observed on photosensitive body under microscope.

D: Black dot image of photosensitive member cycle confirmed on image, adhering matter observed with the naked eye of photosensitive member.

TABLE 5

| | | Transfer efficiency | | Solid followability | | | Black dot images |
|---|---|---|---|---|---|---|---|
| | Toner No. | Rank | Transfer efficiency (%) | After 10,000 sheets | After 20,000 sheets | After 30,000 sheets | After 30,000 sheets |
| Example 1 | 1 | B | 97 | A | A | A | A |
| Example 2 | 2 | B | 97 | A | B | C | A |
| Example 3 | 3 | B | 97 | A | A | A | C |
| Example 4 | 4 | C | 94 | A | A | A | A |
| Example 5 | 5 | A | 99 | A | A | A | C |
| Example 6 | 6 | B | 97 | C | C | C | A |
| Example 7 | 7 | C | 94 | A | A | A | A |
| Example 8 | 8 | B | 97 | B | C | C | A |
| Example 9 | 9 | B | 97 | B | B | C | A |
| Example 10 | 10 | B | 97 | A | A | A | B |

TABLE 5-continued

| | Toner No. | Transfer efficiency | | Solid followability | | | Black dot images |
|---|---|---|---|---|---|---|---|
| | | Rank | Transfer efficiency (%) | After 10,000 sheets | After 20,000 sheets | After 30,000 sheets | After 30,000 sheets |
| Example 11 | 11 | B | 97 | A | A | A | C |
| Example 12 | 12 | C | 91 | A | A | A | A |
| Example 13 | 13 | C | 94 | A | A | A | A |
| Example 14 | 14 | A | 98 | A | A | A | B |
| Example 15 | 15 | A | 99 | A | A | A | C |
| Example 16 | 16 | B | 97 | A | A | B | A |
| Example 17 | 17 | B | 97 | B | B | B | A |
| Example 18 | 18 | B | 97 | A | B | C | B |
| Comparative Example 1 | Comparative 1 | B | 97 | A | D | D | A |
| Comparative Example 2 | Comparative 2 | B | 97 | A | C | D | A |
| Comparative Example 3 | Comparative 3 | B | 97 | A | A | A | D |
| Comparative Example 4 | Comparative 4 | D | 89 | A | A | A | A |
| Comparative Example 5 | Comparative 5 | A | 99 | A | B | B | D |
| Comparative Example 6 | Comparative 6 | B | 97 | D | D | D | A |
| Comparative Example 7 | Comparative 7 | D | 89 | A | A | A | C |

Examples 2 to 18, Comparative Examples 1 to 7

Evaluations were performed as in Example 1 except that toners 2 to 18 and comparative toners 1 to 7 were used. The evaluation results for Examples 2 to 18 and Comparative Examples 1 to 7 are shown in Table 5.

As shown in Table 5, the results of evaluation showed that the toner of the invention achieved excellent transferability and excellent flowability during durable image output, while suppressing contamination of the member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246994, filed Dec. 28, 2018, which is hereby incorporated by reference herein in its entirety.

What is claimed is:

1. A toner, comprising:

a toner particle containing a binder resin, and an external additive comprising an external additive A and an external additive B;

external additive A being an organosilicon polymer fine particle having primary particles with a number-average particle diameter of 30 to 300 nm; and external additive B being a silica fine particle having primary particles with a number-average particle diameter of 100 to 300 nm, wherein a fixing rate of external additive A to the toner particle according to a water washing method is less than 30%, and a fixing rate of external additive B to the toner particle according to the water washing method is at least 30%.

2. The toner according to claim 1, wherein a content of external additive A in the toner is 0.50 to 6.00 mass %, and a content of external additive B in the toner is 0.10 to 3.00 masse %.

3. The toner according to claim 1, wherein shape factors SF-1 of the external additive A and the external additive B are from 100 to 114.

4. The toner according to claim 1, wherein the fixing rate of external additive A is not more than 25%, and the fixing rate of external additive B is at least 35%.

5. The toner according to claim 1, wherein the organosilicon polymer fine particle has a structure of alternately bonded silicon atoms and oxygen atoms, and part of the organosilicon polymer has a T3 unit structure represented by $R^aSiO_{3/2}$ where $R^a$ represents a $C_{1-6}$ alkyl group or phenyl group.

6. The toner according to claim 5, wherein a ratio of an area of a peak derived from silicon having the T3 unit structure relative to a total area of peaks derived from all silicon elements contained in the organosilicon polymer fine particle is 0.50 to 1.00 in $^{29}$Si-NMR measurement of the organosilicon polymer fine particle.

* * * * *